US007625046B2

(12) United States Patent
Sanchez

(10) Patent No.: US 7,625,046 B2
(45) Date of Patent: Dec. 1, 2009

(54) TASK CHAIR

(75) Inventor: Gary L. Sanchez, Albuquerque, NM (US)

(73) Assignee: Garrex LLC, Albuquerque, NM (US)

( * ) Notice: Subject to any disclaimer, the term of this patent is extended or adjusted under 35 U.S.C. 154(b) by 380 days.

(21) Appl. No.: 11/329,776

(22) Filed: Jan. 10, 2006

(65) Prior Publication Data

US 2007/0236066 A1 Oct. 11, 2007

Related U.S. Application Data

(63) Continuation-in-part of application No. 11/032,594, filed on Jan. 10, 2005, now Pat. No. 7,396,082, which is a continuation-in-part of application No. 10/888,318, filed on Jul. 9, 2004, now abandoned, which is a continuation-in-part of application No. 10/401,481, filed on Mar. 28, 2003, now Pat. No. 7,040,703.

(60) Provisional application No. 60/368,157, filed on Mar. 29, 2002, provisional application No. 60/485,775, filed on Jul. 9, 2003, provisional application No. 60/528,427, filed on Dec. 9, 2003.

(51) Int. Cl.
*A47C 7/46* (2006.01)

(52) U.S. Cl. ..... 297/353; 297/217.2; 297/284.4

(58) Field of Classification Search ..... 297/217, 297/284.1, 284.4, 300.8, 302.5, 302.7, 353, 297/354.1, 354.12, 452.26, 452.29
See application file for complete search history.

(56) References Cited

U.S. PATENT DOCUMENTS 567,096 A 9/1896 Harvey et al.
1,007,985 A 11/1911 Smith
1,414,637 A 5/1922 Gell
2,060,298 A 11/1936 Gailey
2,182,598 A 12/1939 Owler
2,304,349 A 12/1942 Fox
2,712,346 A 7/1955 Sprinkle
2,859,797 A 11/1958 Mitchelson
2,859,801 A 11/1958 Moore
3,015,148 A 1/1962 Haddad
3,041,109 A 6/1962 Eames et al.
3,059,971 A 10/1962 Becker
3,072,436 A 1/1963 Moore
3,107,991 A 10/1963 Taussig
3,112,987 A 12/1963 Griffiths et al.
3,115,678 A 12/1963 Keen et al.
3,124,092 A 3/1964 Raynes
3,124,328 A 3/1964 Kortsch
3,165,359 A 1/1965 Ashkouti
3,208,085 A 9/1965 Grimshaw
3,214,314 A 10/1965 Rowbottam
3,248,147 A 4/1966 Testa
3,273,877 A 9/1966 Geller et al.
3,298,743 A 1/1967 Albinson et al.
3,301,931 A 1/1967 Morin
3,314,721 A 4/1967 Smith (Continued)

*Primary Examiner*—Peter R. Brown
(74) *Attorney, Agent, or Firm*—Luedeka, Neely & Graham, PC

(57) ABSTRACT

The present invention relates to task chairs that support the body of the user in healthy positions while the user performs various tasks over extended sitting periods and that provide independent and independently adjustable support to the lower and the upper back.

18 Claims, 10 Drawing Sheets

U.S. PATENT DOCUMENTS

| | | | |
|---|---|---|---|
| 3,333,811 | A | 8/1967 | Matthews |
| 3,337,267 | A | 8/1967 | Rogers, Jr. |
| 3,399,926 | A | 9/1968 | Hehn |
| 3,431,022 | A | 3/1969 | Poppe et al. |
| 3,434,181 | A | 3/1969 | Benzies |
| 3,436,048 | A | 4/1969 | Greer |
| 3,534,129 | A | 10/1970 | Bartel |
| 3,544,163 | A | 12/1970 | Krein |
| 3,589,967 | A | 6/1971 | Shirakawa |
| 3,601,446 | A | 8/1971 | Persson |
| 3,624,814 | A | 11/1971 | Borichevsky |
| 3,640,576 | A | 2/1972 | Morrison et al. |
| 3,758,356 | A | 9/1973 | Hardy |
| 3,807,147 | A | 4/1974 | Schoonen |
| 3,817,806 | A | 6/1974 | Anderson et al. |
| 3,844,612 | A | 10/1974 | Borggren et al. |
| 3,864,265 | A | 2/1975 | Markley |
| 3,880,463 | A | 4/1975 | Shephard et al. |
| 3,902,536 | A | 9/1975 | Schmidt |
| 3,915,775 | A | 10/1975 | Davis |
| 3,932,252 | A | 1/1976 | Woods |
| 3,947,068 | A | 3/1976 | Buhk |
| 3,961,001 | A | 6/1976 | Bethe |
| 3,965,944 | A | 6/1976 | Goff, Jr. et al. |
| 3,999,802 | A | 12/1976 | Powers |
| 4,008,029 | A | 2/1977 | Shokite |
| 4,010,980 | A | 3/1977 | Dubinsky |
| 4,013,257 | A | 3/1977 | Paquette |
| 4,018,479 | A | 4/1977 | Ball |
| 4,019,776 | A | 4/1977 | Takamatsu |
| 4,036,524 | A | 7/1977 | Takamatsu |
| 4,046,611 | A | 9/1977 | Sanson |
| 4,047,756 | A | 9/1977 | Ney |
| 4,062,590 | A | 12/1977 | Polsky et al. |
| 4,067,249 | A | 1/1978 | Deucher |
| 4,087,224 | A | 5/1978 | Moser |
| 4,107,371 | A | 8/1978 | Dean |
| 4,108,416 | A | 8/1978 | Nagase et al. |
| 4,113,627 | A | 9/1978 | Leason |
| 4,116,736 | A | 9/1978 | Sanson et al. |
| 4,125,490 | A | 11/1978 | Hettinga |
| 4,149,919 | A | 4/1979 | Lea et al. |
| 4,152,023 | A | 5/1979 | Buhk |
| 4,161,504 | A | 7/1979 | Baldini |
| 4,174,245 | A | 11/1979 | Martineau |
| 4,189,880 | A | 2/1980 | Ballin |
| 4,190,286 | A | 2/1980 | Bentley |
| 4,299,645 | A | 11/1981 | Newsom |
| 4,302,048 | A | 11/1981 | Yount |
| 4,314,728 | A | 2/1982 | Faiks |
| 4,336,220 | A | 6/1982 | Takahashi |
| 4,339,488 | A | 7/1982 | Brokmann |
| 4,364,887 | A | 12/1982 | Becht et al. |
| 4,373,692 | A | 2/1983 | Knoblauch et al. |
| 4,375,301 | A | 3/1983 | Pergler et al. |
| 4,380,352 | A | 4/1983 | Diffrient |
| 4,390,206 | A | 6/1983 | Faiks et al. |
| 4,411,469 | A | 10/1983 | Drabert et al. |
| 4,429,917 | A | 2/1984 | Diffrient |
| 4,438,898 | A | 3/1984 | Knoblauch et al. |
| 4,465,435 | A | 8/1984 | Copas |
| 4,469,738 | A | 9/1984 | Himelreich, Jr. |
| 4,469,739 | A | 9/1984 | Gretzinger et al. |
| 4,494,795 | A | 1/1985 | Roossien et al. |
| 4,502,729 | A | 3/1985 | Locher |
| 4,522,444 | A | 6/1985 | Pollock |
| 4,529,247 | A | 7/1985 | Stumpf et al. |
| 4,545,614 | A | 10/1985 | Abu-Isa et al. |
| 4,548,441 | A | 10/1985 | Ogg |
| 4,568,455 | A | 2/1986 | Huber et al. |
| 4,575,150 | A | 3/1986 | Smith |
| 4,595,237 | A | 6/1986 | Nelsen |
| 4,601,516 | A | 7/1986 | Klein |
| 4,611,851 | A | 9/1986 | Noyes et al. |
| 4,629,249 | A | 12/1986 | Yamaguchi |
| 4,629,525 | A | 12/1986 | Rasmussen |
| 4,634,178 | A | 1/1987 | Carney |
| 4,638,679 | A | 1/1987 | Tannenlaufer |
| 4,640,547 | A | 2/1987 | Fromme |
| 4,643,481 | A | 2/1987 | Saloff et al. |
| 4,653,806 | A | 3/1987 | Willi |
| 4,666,121 | A | 5/1987 | Choong et al. |
| 4,668,012 | A | 5/1987 | Locher |
| 4,670,072 | A | 6/1987 | Pastor et al. |
| 4,691,961 | A | 9/1987 | Rogers, Jr. et al. |
| 4,703,974 | A | 11/1987 | Brauning |
| 4,709,443 | A | 12/1987 | Bigley |
| 4,709,962 | A | 12/1987 | Steinmann |
| 4,720,142 | A | 1/1988 | Holdredge et al. |
| 4,743,323 | A | 5/1988 | Hettinga |
| 4,761,033 | A | 8/1988 | Lanuzzi et al. |
| 4,763,950 | A | 8/1988 | Tobler |
| 4,776,633 | A | 10/1988 | Knoblock et al. |
| 4,779,925 | A | 10/1988 | Heinzel |
| 4,793,197 | A | 12/1988 | Petrovsky |
| 4,796,950 | A | 1/1989 | Mrotz, III et al. |
| 4,796,955 | A | 1/1989 | Williams |
| 4,803,118 | A | 2/1989 | Sogi et al. |
| 4,815,499 | A | 3/1989 | Johnson |
| 4,815,789 | A | 3/1989 | Marcus |
| 4,819,458 | A | 4/1989 | Kavesh et al. |
| 4,826,249 | A | 5/1989 | Bradbury |
| 4,829,644 | A | 5/1989 | Kondo et al. |
| 4,830,697 | A | 5/1989 | Aizawa |
| 4,831,697 | A | 5/1989 | Urai |
| 4,842,257 | A | 6/1989 | Abu-Isa et al. |
| 4,846,230 | A | 7/1989 | Mock et al. |
| 4,852,228 | A | 8/1989 | Zeilinger |
| 4,860,415 | A | 8/1989 | Witzke |
| 4,861,106 | A | 8/1989 | Sondergeld |
| 4,869,554 | A | 9/1989 | Abu-Isa et al. |
| 4,885,827 | A | 12/1989 | Williams |
| 4,889,384 | A | 12/1989 | Sulzer |
| 4,889,385 | A | 12/1989 | Chadwick et al. |
| 4,892,254 | A | 1/1990 | Schneider et al. |
| 4,902,069 | A | 2/1990 | Lehnert |
| 4,904,430 | A | 2/1990 | Yamada |
| 4,906,045 | A | 3/1990 | Hofman |
| 4,927,698 | A | 5/1990 | Jaco et al. |
| 4,939,183 | A | 7/1990 | Abu-Isa et al. |
| 4,942,006 | A | 7/1990 | Loren |
| 4,943,115 | A | 7/1990 | Stucki |
| 4,946,224 | A | 8/1990 | Leib |
| 4,961,610 | A | 10/1990 | Reeder et al. |
| 4,966,411 | A | 10/1990 | Katagiri et al. |
| 4,968,366 | A | 11/1990 | Hukki et al. |
| 4,979,778 | A | 12/1990 | Shields |
| 4,981,325 | A | 1/1991 | Zacharkow |
| 4,981,326 | A | 1/1991 | Heidmann |
| 4,986,948 | A | 1/1991 | Komiya et al. |
| 4,988,145 | A | 1/1991 | Engel |
| 5,000,515 | A | 3/1991 | Deview |
| 5,009,827 | A | 4/1991 | Abu-Isa et al. |
| 5,009,955 | A | 4/1991 | Abu-Isa |
| 5,013,089 | A | 5/1991 | Abu-Isa et al. |
| 5,015,034 | A | 5/1991 | Kindig et al. |
| 5,029,940 | A | 7/1991 | Golynsky et al. |
| 5,033,791 | A | 7/1991 | Locher |
| 5,070,915 | A | 12/1991 | Kalin |
| 5,071,189 | A | 12/1991 | Kratz |
| 5,096,652 | A | 3/1992 | Uchiyama et al. |
| 5,100,713 | A | 3/1992 | Homma et al. |
| 5,106,678 | A | 4/1992 | Abu-Isa |
| 5,107,720 | A | 4/1992 | Hatfield |

5,114,211 A 5/1992 Desanta
5,116,556 A 5/1992 Danton
5,117,865 A 6/1992 Lee
5,135,694 A 8/1992 Akahane et al.
5,143,422 A 9/1992 Althofer et al.
5,153,049 A 10/1992 Groshens
5,228,747 A 7/1993 Greene
5,240,308 A 8/1993 Goldstein et al.
5,288,130 A 2/1994 Foster
5,288,135 A 2/1994 Forcier et al.
5,346,284 A * 9/1994 Dauphin ..... 297/411.36
5,407,248 A 4/1995 Jay et al.
5,501,507 A 3/1996 Hummitzsch
5,547,251 A 8/1996 Axelson
5,678,891 A 10/1997 O'Neill et al.
5,679,891 A 10/1997 Matsuno et al.
5,704,689 A 1/1998 Kim
5,769,497 A * 6/1998 Tsai ..... 297/411.36
6,079,782 A 6/2000 Berg et al.
6,089,664 A 7/2000 Yoshida
6,095,611 A 8/2000 Bar et al.
6,152,532 A 11/2000 Cosentino
6,189,971 B1 2/2001 Witzig
6,193,313 B1 2/2001 Jonsson
6,254,186 B1 7/2001 Falzon
6,334,650 B1 1/2002 Chien-Chuan
6,334,651 B1 1/2002 Duan et al.
6,338,530 B1 1/2002 Gowing
6,352,307 B1 3/2002 Engman
6,386,634 B1 5/2002 Stumpf et al.
6,431,648 B1 8/2002 Cosentino et al.
6,447,061 B1 9/2002 Klingler
6,478,379 B1 11/2002 Ambasz
6,499,802 B2 12/2002 Drira
6,565,155 B1 * 5/2003 Huang ..... 297/353

* cited by examiner

TASK CHAIR

CROSS-REFERENCES TO RELATED APPLICATIONS

This application is a continuation-in-part of, and claims priority to, U.S. patent application Ser. No. 11/032,594, entitled "Task Chair", filed Jan. 10, 2005, which is a continuation-in-part application of: U.S. patent application Ser. No. 10/401,481, entitled "The Health Chair A Dynamically Balanced Task Chair", filed Mar. 28, 2003, which in turn claims the benefit of the filing of U.S. Provisional Patent Application Ser. No. 60/368,157; and also a continuation-in-part application of U.S. patent application Ser. No. 10/888,318, entitled "Task Chair", filed Jul. 9, 2004, which in turn claims the benefit of the filing of U.S. Provisional Patent Application Ser. No. 60/485,775, entitled "Task Chair", filed Jul. 9, 2003, and of U.S. Provisional Patent Application Ser. No. 60/528,427, entitled "Task Chair", filed Dec. 9, 2003; and also claims priority to PCT application Ser. No. US/04/21761, filed Jul. 9, 2004. The claims and specifications of said applications are incorporated herein by reference.

BACKGROUND OF THE INVENTION

1. Field of the Invention (Technical Field)

The present invention relates to task chairs that support the body of the user in healthy positions while the user performs various tasks over extended sitting periods and that provide independent and independently adjustable support to the lower and the upper back.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Today, the average worker performs less physical activity and workers perform increasingly more of their work while in a seated position. It is known that if any part of person's anatomical function is impinged or static (i.e., remaining in a fixed position) for extended periods of time, posture and health are compromised. It has been determined that both physically active and physically inactive people suffer health problems caused by prolonged sitting. Those problems include lower back pain, muscle tension, numbness, acid reflux, carpel tunnel syndrome, and general fatigue.

Peter Escogue, a recognized expert in anatomical function, suggests these problems are posture related as well as inactivity related. Proper anatomical posture promotes proper anatomical function, i.e. the body functions best when operated from a proper position. Escogue further observes that over a period of time, many persons compromise correct posture causing problems in correct anatomical function.

Static, improper posture (e.g., while sitting in a static improper supporting chair) impairs good health. In the prior art, seats and chairs have been designed for comfort and for performing tasks. Task chairs were designed to incorporate pads, tilts, swivels, etc. Over time, health improvements were added to the combination of such items as family room recliners and workers' rigid elevating stools. Additions such as lumbar supports, adjustable armrests, seat backs with shapes designed for a general vertebrae contour, etc., were incorporated. However, today's combination task chairs offer few features to accommodate multiple tasks while simultaneously giving adequate consideration to seating health.

Task chairs are typically configured to allow tilting of the seat and backrest as a unit or tilting of the backrest relative to the seat. In chairs having a backrest pivotally attached to a seat in a conventional manner, the movement of the backrest relative to the seat can create shear forces acting on the legs and back of the user. These shear forces tend to cause an uncomfortable pulling of the user's clothing. In an attempt to compensate for these shear forces, some office chairs include a backrest which pivots while the seat tilts, such as those disclosed in U.S. Pat. Nos. 2,859,801 (to Moore) and U.S. Pat. No. 4,429,917 (to Diffrient).

A related disadvantage of conventional task chairs is the configuration of the seat and/or backrest. Such seats typically include single or multi-density foam padding with a covering such as cloth, leather, mesh material or the like, such seating also tends to provide insufficient aeration since it acts as another layer of clothing and does not contain a spinal relief channel in the back support, and/or contain a coccyx relief in the horizontal seat. In addition, the structural requirements of such an attachment limits the shape and size of the frame and the membrane.

Typically, the seats of office task chairs are supported by a single stage telescoping column which provides for vertical adjustment of the seat. These columns include a gas spring mounted in a telescoping tube which is slidable within a base tube. In accordance with guidelines set by the American National Standards Institute (A.N.S.I.) and Business and Institutional Furniture Manufacturer's Association (B.I.F.M.A.), conventional office chairs in the United States are typically adjustable from a seat height of 16.0 inches from a floor to about 20.5 inches from a floor. Nevertheless, it is desirable to exceed this range of height adjustment to account for very small or large users and to accommodate the international population in general.

Typically, it is difficult to exceed this range of height adjustment with seats which tilt about the knees or ankles of the user. To offset the moments acting on single stage support columns, pneumatic manufacturers typically set a minimum overlapping distance of 2.95 inches (75 mm) between the tubes. Because such "ankle tilt" and "knee tilt" chairs have relatively large tilt housings, it is difficult to provide a lower minimum and higher maximum seat height while maintaining the required overlapping distance between the tubes. These types of tilting chairs also impart a greater moment on the tube since the pivot axis is offset from the support column. It is therefore desirable to provide a vertically adjustable support column having a greater overlapping distance to permit a greater stroke which decreases the minimum height and increases the maximum height of a chair seat.

Devices that incorporate a plurality of adjustable means have been disclosed in the prior art such as, for example, U.S. Pat. Nos. 6,478,379 (to Ambasz) and 6,189,971 (to Witzig). However, those devices do not allow for the independent adjustment of multiple, vertical backrest support arms.

Other patents disclose the use of various seat and back units incorporating means for altering the contour of the pads used on such seats such as, for example, U.S. Pat. Nos. 6,499,802 (to Drira) and 6,447,061 (to Klingler). However, these devices do not allow for the independent adjustment of multiple, vertical backrest support arms.

Although offering varying shapes, contours, masses and sizes, as well as a wide range of adjustment means i.e. pivotal, tilt, height, in/out, up/down, soft/firm, etc., all attempts at healthy task chairs in the prior art are burdened with an interdependent posterior design support which ultimately restricts and compromises adjustability, dynamic support, and active seating. A chair that provides better posterior support and continuous animation, and better supports task functions, is thus needed.

BRIEF SUMMARY OF THE INVENTION

The present invention provides a chair with independently adjustable back supports to accommodate a variety of seating positions, user anatomies, and tasks.

Thus, an embodiment of the present invention provides an adjustable chair comprising a base, a seat comprising a seating surface, said seat connected to the base, a back support control assembly connected to the seat, at least two adjustable, generally vertical back support arms pivotally attached to the back support control assembly at a control assembly pivot point and each said back support arm independently adjustable about the respective control assembly pivot points, said back support arms adjustable to form an acute angle relative to the seating surface in a range of from an acute angle to an obtuse angle, and a vertically adjustable back support disposed on each back support arm, a first of the back supports for supporting a lower back of a seated person and a second of the back supports supporting an upper back of the seated person and disposed in a vertical plane generally aft of the first back support, wherein independently adjusting the back support arms about their respective control assembly pivot points moves the back support positions fore and aft.

The chair further comprises adjustment controls for adjusting a position of each back support arm, said adjustment controls accessible to a user while seated. The back supports are preferably pivotally attached to the back support arms so that the back supports may tilt irrespective of a position of the back support arms about the control assembly pivot points. The chair preferably further comprises a first adjuster connected to the first back support and further comprises a second adjuster connected to the second back support, said adjustment controls accessible to a user while seated. The first adjuster and the second adjuster preferably comprise adjustable settings for adjustment of a position of the back supports on each respective back support arm, said adjusters comprising calibrations visible to the user. The back support control assembly preferably comprises pneumatic components attached to the back support arms to move and fix a position of each back support arm. Preferably, the first adjuster faces toward a front of the chair, and the second adjuster faces toward a rear of the chair.

The pneumatic components preferably comprise a first pneumatic cylinder linked to the first back support arm and a second pneumatic cylinder linked to the second back support arm, each of the pneumatic cylinders independently linked to an adjustor control via an actuator cable.

Preferably, each back support comprises a spinal relief channel and the seating surface further comprises a coccyx pressure relief depression.

The chair may further comprise at least two adjustable forearm supports that are preferably tiltably adjustable, preferably adjustable in a direction toward, and away from, a center of the chair, preferably adjustable in height, and preferably rotatably adjustable.

In another embodiment, the chair comprises at least one adjustment alert to remind a user to make positional adjustments of the back support arms, the back supports, the forearm supports, the height of the seating surface, or a combination thereof.

Another embodiment provides a chair comprising a base, a seat comprising a seating surface, said seat connected to the base, a back support control assembly connected to the seat, at least two independently adjustable, generally vertical back support arms attached to the back support control assembly, a vertically adjustable back support disposed on each back support arm, a first of said back supports for supporting a lower back of a seated person and a second of said back supports supporting an upper back of the seated person, a first adjusting component connected to the first back support for adjusting the first back support, and a second adjusting component connected to the second back support, wherein the adjusting components are accessible to a user while the user is seated. Preferably, the first adjuster faces toward a front of the chair, and the second adjuster faces toward a rear of the chair. In one embodiment, one of the adjusting components comprises an indicator comprising a letter, and/or at least one of the adjusting components comprises an indicator comprising a number. In another embodiment, at least one of the adjusting components comprises an indicator comprising a window showing a number, and another of the adjusting components comprises an indicator comprising a window showing a letter.

Another embodiment provides a chair comprising a base, a seat comprising a seating surface, said seat connected to the base, a back support control assembly connected to the seat, at least two independently adjustable, generally vertical back support arms attached to the back support control assembly, a vertically adjustable back support disposed on each back support arm, a first of said back supports for supporting a lower back of a seated person and a second of said back supports supporting an upper back of the seated person, and a first adjusting component and a second adjusting component for adjusting the first and second back supports, each said adjusting component comprising adjustable settings for adjustment of a position of the back supports on each respective back support arm, said adjusting components comprising calibration indicators visible to a user. In one embodiment, at least one of the calibration indicators comprises a letter and/or one of the calibration indicators comprises a number. In another embodiment, at least one of the calibration indicators comprises a window showing a number, and another of the calibration indicators comprises a window showing a letter.

A primary object of the present invention is to provide a task chair that promotes healthier seating by supporting proper anatomical posture and proper skeletal support and that supports multiple task functions over extended seating periods of time.

A primary advantage of the present invention is that it provides independent upper back support and lower back support that are easily and independently adjustable.

Another advantage of the present invention is that it provides anatomical support to the user while the user performs a wide range of tasks in a seated position.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention relates to chairs that support the body of the user in healthy positions while the user performs various tasks over extended sitting periods of time and that provide independent, and independently adjustable, support to the lower back and the upper back of the user.

As used in the specification and claims herein, the terms "a", "an", and "the" mean one or more.

Figure 1:
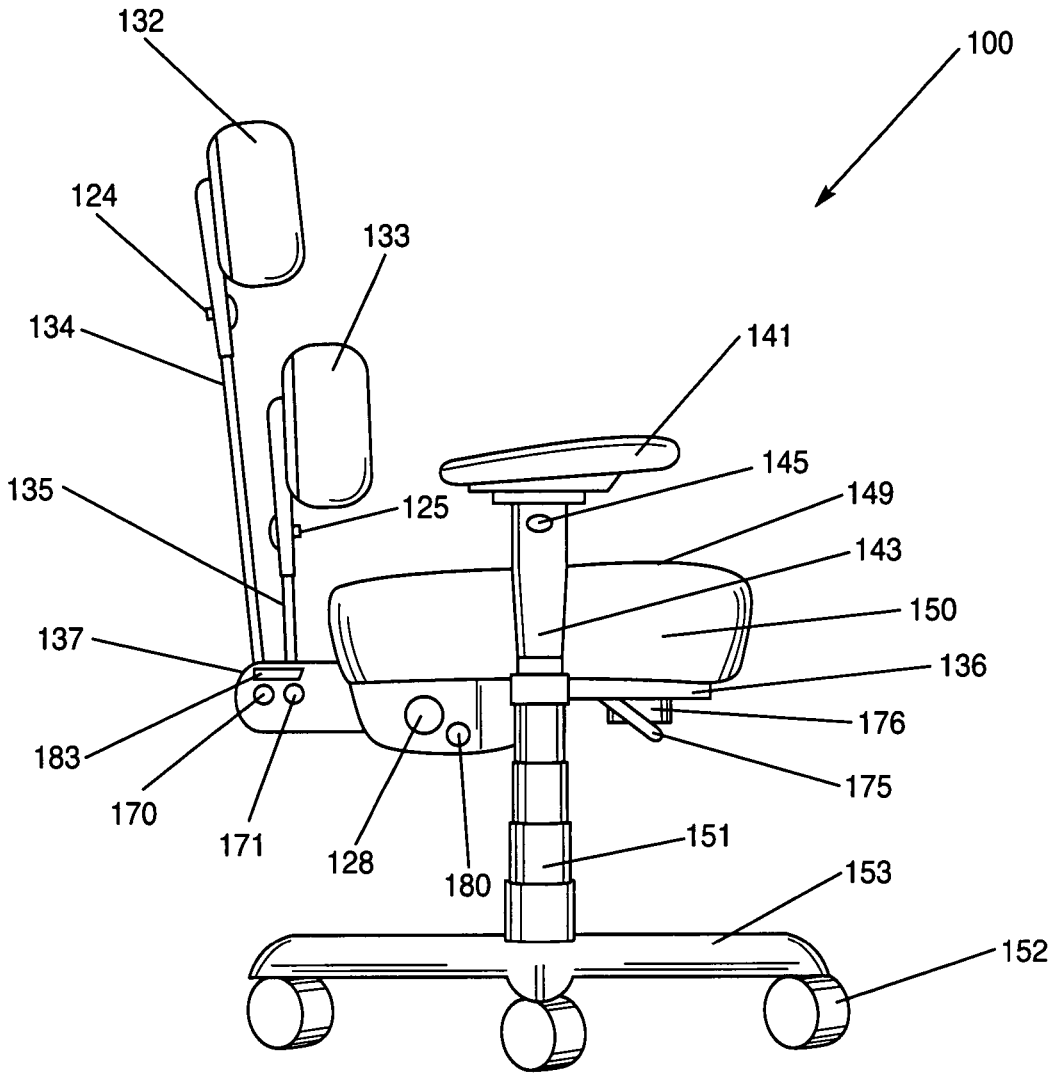
FIG. 1 is a side view of an embodiment of the present invention.

Turning now to the figures, which describe a non-limiting embodiment of the present invention that is illustrative of the various embodiments within the scope of the present invention, FIG. 1 shows Chair 100 comprising seat 150 preferably attached via seat frame 136 to base 153, and preferably comprises pedestal 151 positioned between base 153 and seat frame 136. Pedestal 151 is preferably adjustable via any means known in the art, such as via telescoping means, and is preferably movably supported by rolling components (such as casters) 152 that are connected to base 153.

Chair 100 also comprises back supports 132, 133. Either, or both, of back supports 132, 133 are preferably adjustable to include adjustability in a vertical direction (i.e. height). Adjusting components or systems 124, 125 are preferably incorporated to make such adjustments. Preferably, adjusting component 124 is positioned to face rearward of chair 100, and adjusting component 125 is positioned to face toward the front of chair 100, although other positions are within the scope of the present invention. Preferably, adjusting components 124 and 125 (as well as adjustment controls 126 and 128 described below) are accessible to the user while the user is seated and the user may adjust the settings and thus the configuration of component 124, 125 while being seated. Preferably, chair 100 comprises two back supports, but more may be utilized in other embodiments.

Back supports 132 and 133 are attached to vertical back support arms 134, 135, respectively, at least one of which is preferably adjustable. Back support arms 134 and 135 are preferably attached to seat frame 136 via back support control assembly 137.

The height of either back supports 132, 133 may be adjusted by moving them up and down along back support arms 134 and 135 (as shown in the figures) or, in another embodiment, by adjusting the length of brace support members 134 and 135.

Figure 2:
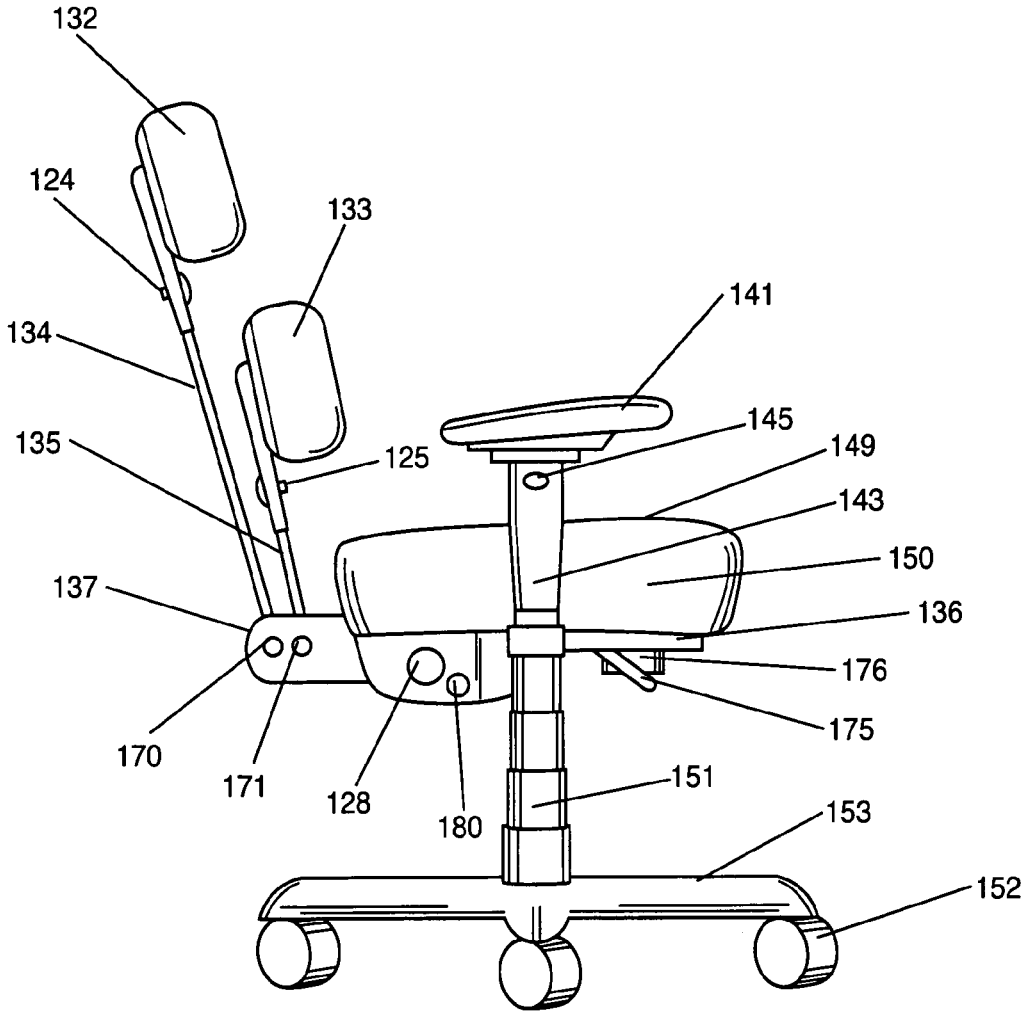
FIG. 2 is a side view of the embodiment of FIG. 1 showing back support arms in a slightly reclined position.
Figure 3:
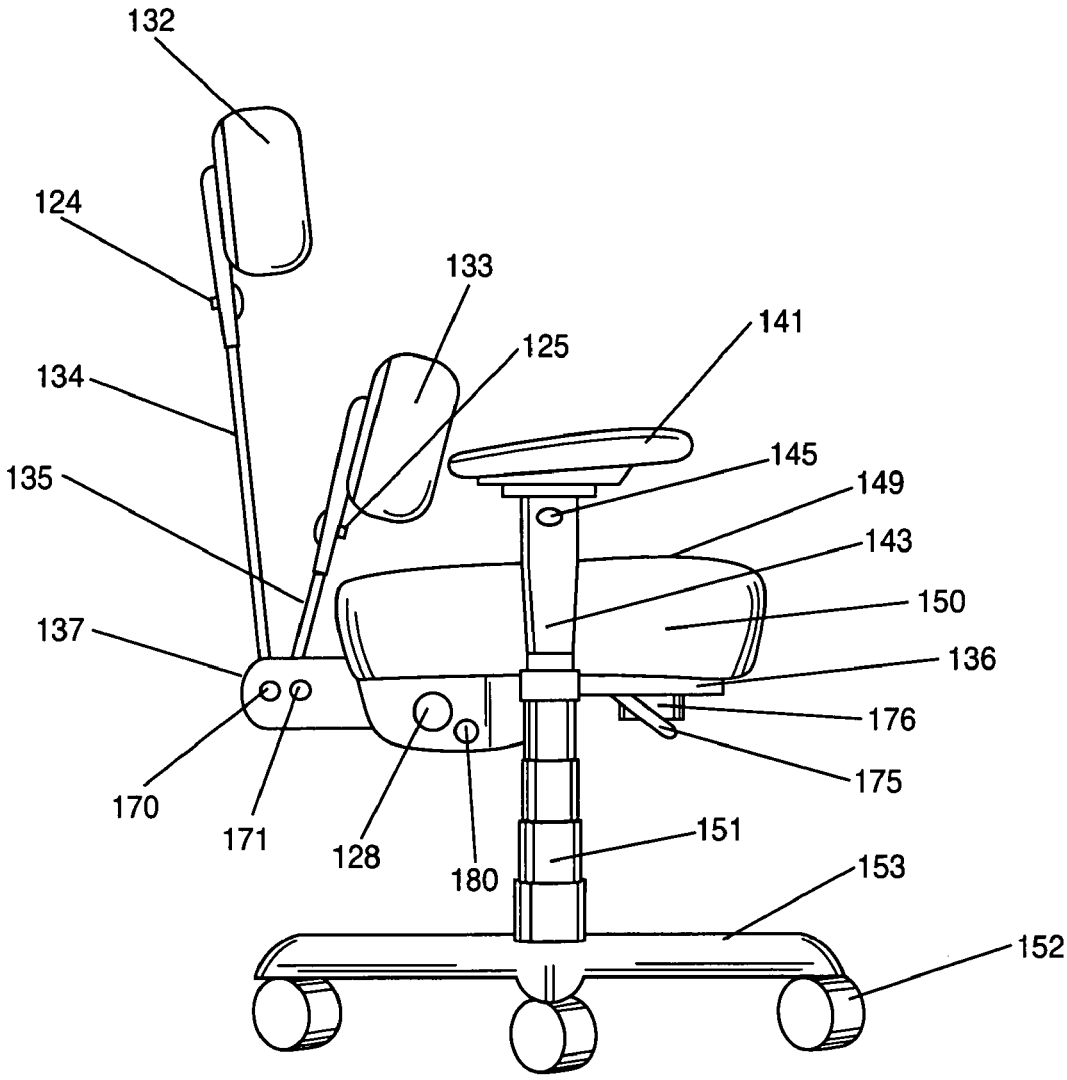
FIG. 3 is a side view of the embodiment of FIG. 1 showing one back support arm in a forward inclined position and one back support arm in a slightly reclined position.
Figure 4:
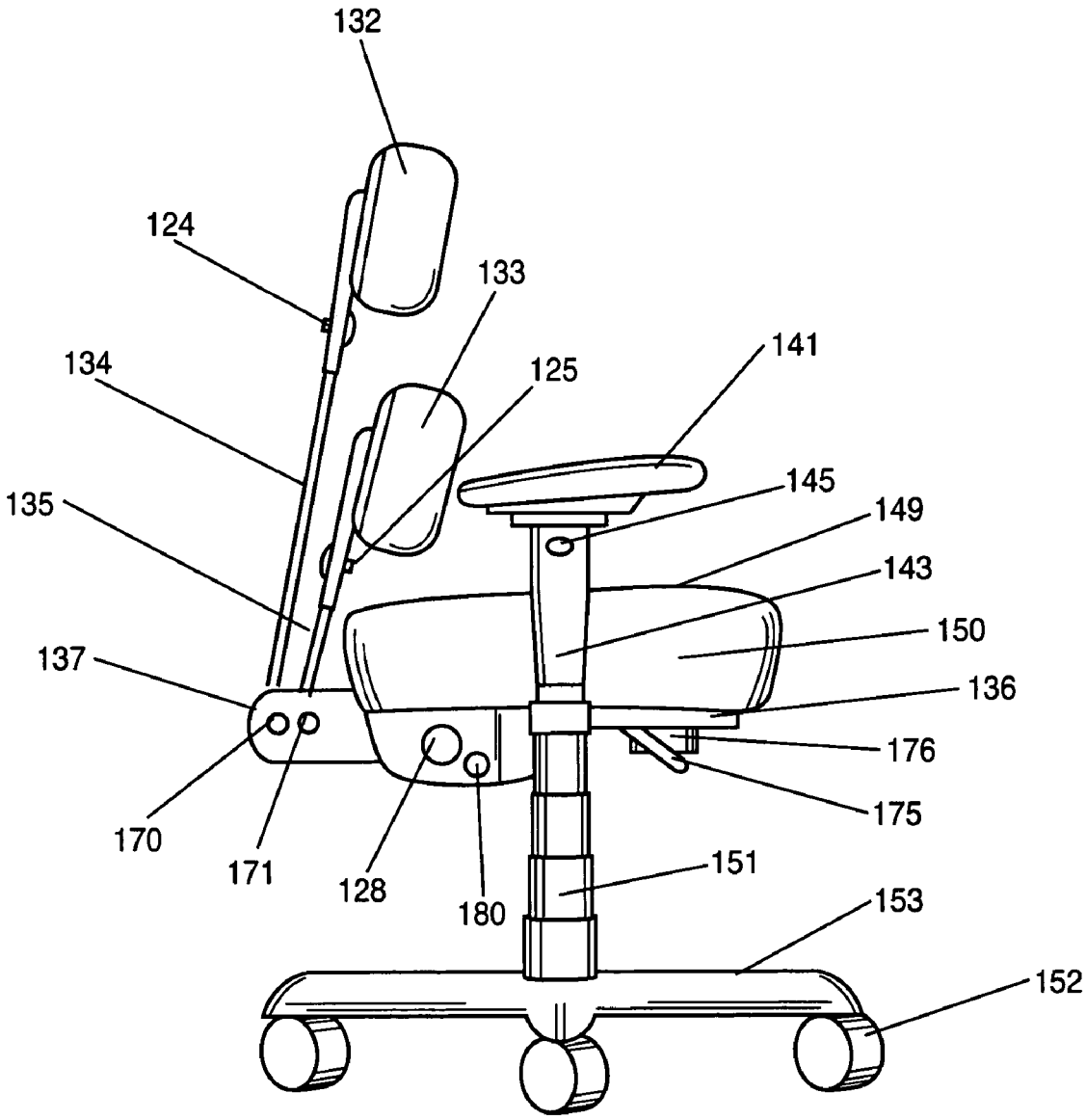
FIG. 4 is a side view of the embodiment of FIG. 1 wherein both back support arms are in a forward inclined position.

Back support arms 134, 135 are independently and pivotally attached to back support control assembly 137 at pivot points 170, 171 as more fully described herein. Preferably, adjustment controls 126 and 128 (e.g., control buttons) are utilized, as discussed in more detail below, to adjust the angle of each back support arm 134, 135 in relation to seat surface 149 from the rear to the front of chair 100 in such a way that a broad range of angles, from acute to obtuse, is provided. These adjustments are also preferably accomplished while the user is seated by pressing adjustment controls 126, 128 linked to back support arms 134, 135 as described below. Thus, each back support arm 134 and 135 are independently adjustable by pivoting about pivot points 170 and 171, respectively, so that back supports 132 and 133 may be moved fore and aft to accommodate a variety of sitting positions, user anatomies, and user tasks. FIGS. 2-4 show some of the range of adjustability.

Also, back supports 132 and 133 preferably comprise pivoting points 190, 191 (shown in FIG. 6) about which back supports 132 and 133 may tilt to accommodate a user's anatomy as back support arms 134 and 135 are pivoted to movably adjust back supports 132 and 133 fore and aft. Thus, the overall fore and aft movement of back supports 132 and 133 throughout their movable range is in the form of an arc. By adjusting the height of back supports 132 and 133 via adjustment controls 126 and 128, the effect of the arcing movement in changing the height of back supports 132 and 133 can be minimized, buffered, or otherwise controlled.

In the preferred embodiment, back support arm 134, which is longer than back support arm 135, is disposed directly behind back support arm 135. This positioning of back support arms 134, 135 in such an orientation results not only in a more aesthetic appearance for chair 100, but also enables a user to straddle back support arms 134, 135 while sitting in chair 100 facing toward a rear of chair 100. Sitting while facing toward the rear of chair 100 enables the user to gain not only abdominal support from back support 133, but also to gain upper chest support from back support 132. Such support is often needed by users who engage in activities that require a substantial amount of time looking downward. For example dentists, jewelers, dental lab technicians, and computer wafer manufacturers would all benefit from anterior support.

Thus, chair 100 provides flexibility through adaptability. For example, as noted above, when the user requires anterior (forward) support, the seating can be reversed (i.e., the user can sit facing toward the rear of the chair) to accommodate forward tasks. As noted below, should the user require elbow and lower arm support, adjustable forearm support members 140, 141 are adjustable to support vertical and lateral task movements.

Figure 6:
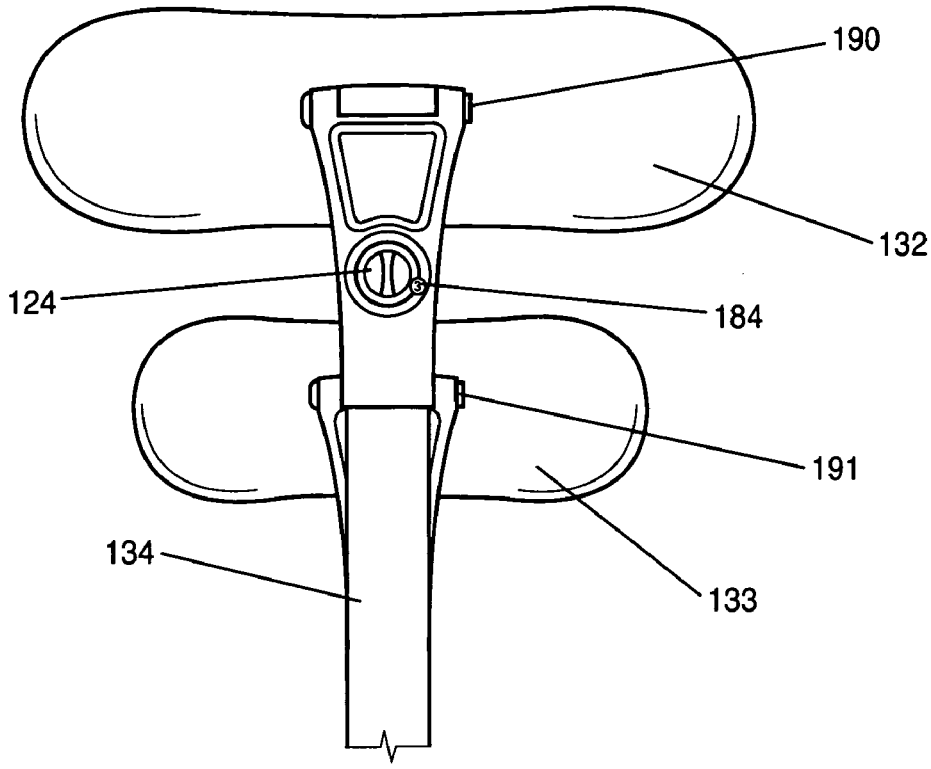
FIG. 6 is a rear view of a back support arm showing an adjustment control and a position setting indicator for an upper back support.
Figure 7:
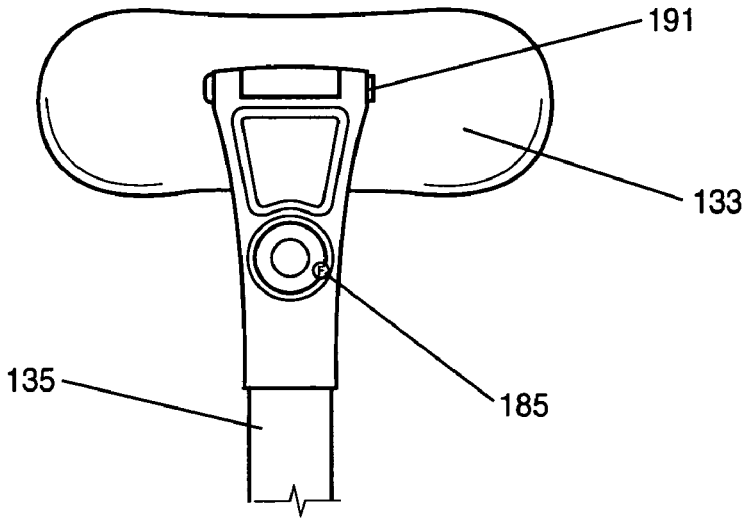
FIG. 7 is a rear view of a lower back support and a position setting indicator.

In another embodiment of the present invention, the positions of any or all of back supports 132 and 133 and back support arms 134 and 135 are calibrated to a user's desired settings. Thus, calibration indicators, such as window indicators 184, 185, for indicating the height of adjustable back support members 132, 133 are provided. These would enable each user to quickly return the height of adjustable back support members 132 and 133 or the position of back support arms 134 and 135 to the user's desired setting. As an example, one person might prefer an indicator showing settings of "3" and "F" whereas another user might prefer "2" and "B" settings (a window with a setting of "3" is shown in FIG. 6, and a window with a setting of "F" is shown in FIG. 7). Numerous apparatuses known in the art can be utilized to achieve this objective. This allows quickly resetting the chair positions which is particularly useful in offices (e.g., medical or dental offices) where different persons move to different offices throughout the day. Another example may comprise one or more dials with an indicator (not shown) that point to a series of numbers (i.e. an apparatus similar to a volume knob). The apparatus can also be incorporated by disposing an indicator, such as window indicator 183 (shown in FIG. 1) at the side or back of holding component 137, wherein one or more scales (not shown) may be displayed and affixed to each of brace support members 134, 135. Therefore, when brace support members 134, 135 are moved, the scale would slide, thus showing a different numbered setting. Thus, it is understood that such indicators may comprise any of the means described herein or a combination of such means and may be located anywhere on chair 100.

Figure 5:
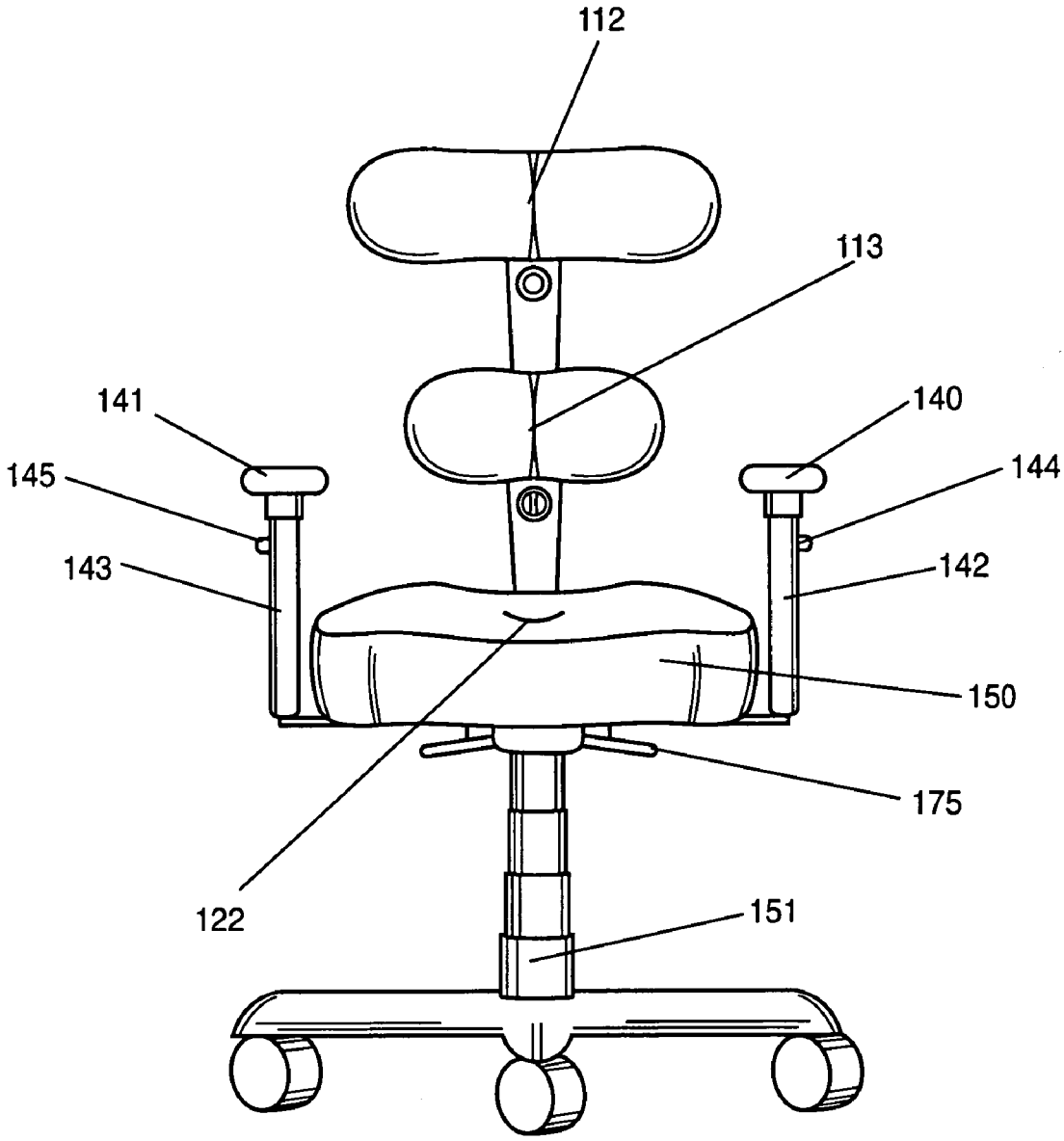
FIG. 5 is a front view of the embodiment of FIG. 1.

FIGS. 1-5 show adjustable forearm support 141 secured to seat 150 via forearm attachment member 143 which is provided with forearm support adjustor 145. FIG. 5 shows corresponding forearm support 140, forearm attachment member 142, and forearm support adjustor 144 on the other side of chair 100. Any means known in the art may be utilized to accomplish the adjustment of the height of forearm support members 140, 141 such as, for example, using telescoping means to adjust the length of forearm attachment members 142, 143.

In one embodiment, when the user requires elbow and lower arm support, whether anterior or posterior, forearm supports 140, 141 comprise adjustment flexibility to accommodate adjustments to the "tilt arm rest" from up to down, inwardly and outwardly, and to tilt downwardly from the posterior to anterior allowing an angled support. This capability is useful for such tasks as typing as it has been suggested that a proper, healthy typing position involves a relaxed upper arm and shoulder support at the elbow, while simultaneously allowing lower arm, wrist, and hand to be in straight alignment angled downwardly from the elbow. This typing posture helps prevent carpel tunnel syndrome. Forearm supports 140, 141 are adjustable along all planes, including tilt, rotation, and in a direction toward and away from the center of chair 100.

In the preferred embodiment, as shown in FIG. 5, adjustable back supports 132, 133 comprise vertical indentations 111, 113 (i.e., spinal relief channels) to relieve pressure that is applied against the spinal column of a user when the user reclines against back supports 132, 133. Indentations 111, 113 may be of any size sufficient to relieve pressure to the spine of a user. In another embodiment, back supports 132, 133 can each comprise two pads (not shown) connectedly spaced apart so that the space between them accommodates the immediate area of the spine to relieve pressure or remove pressure to the spine.

FIG. 5 also shows seat member 150 comprising indentation 122 to relieve pressure to the coccyx of a user that results when the user sits on seat member 150. Indentation 122 may be of any size and shape including, but not limited to, rectangles or squares.

Figure 8:
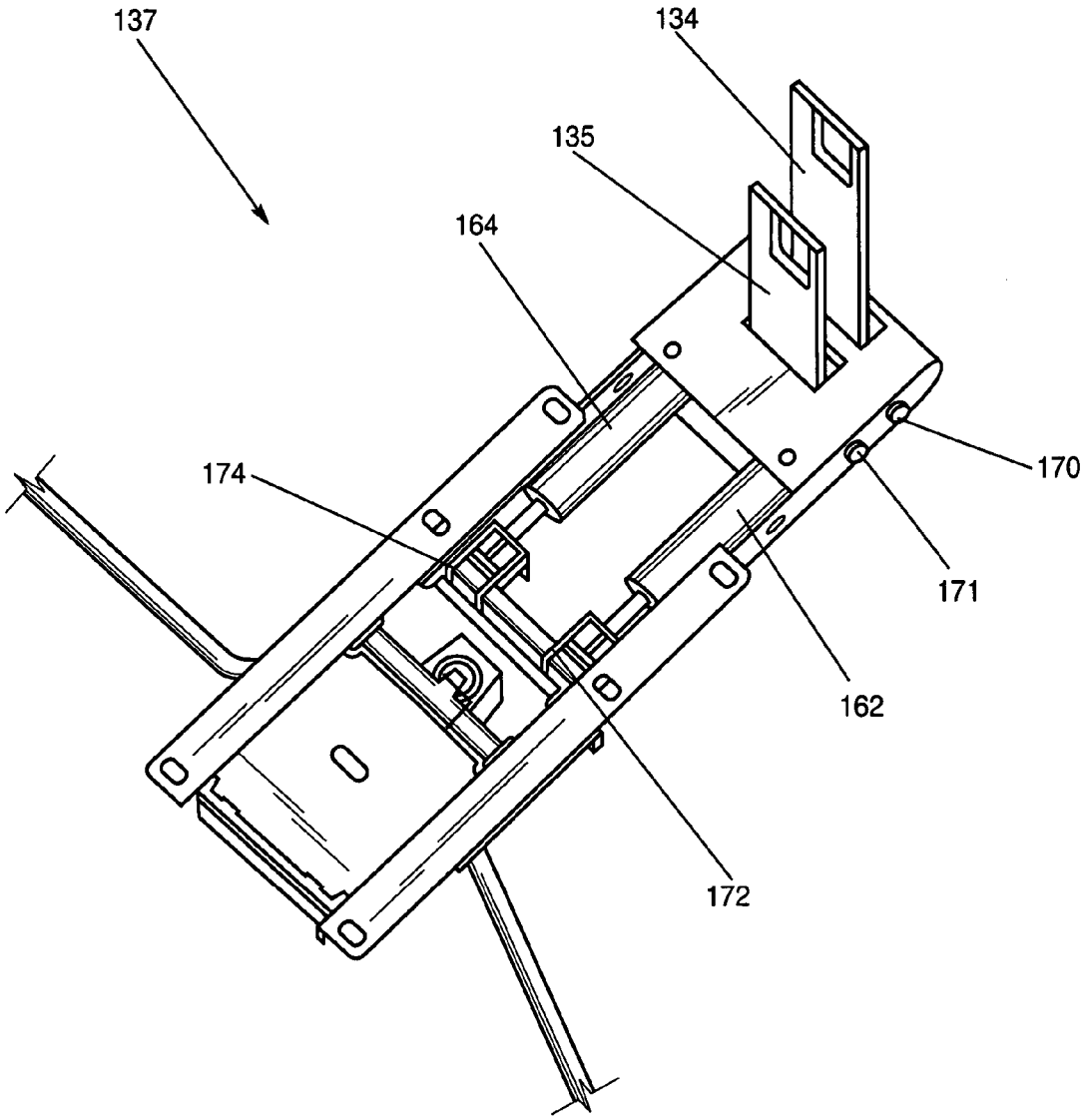
FIG. 8 is a top perspective view of the back support control assembly of an embodiment of the present invention.
Figure 9:
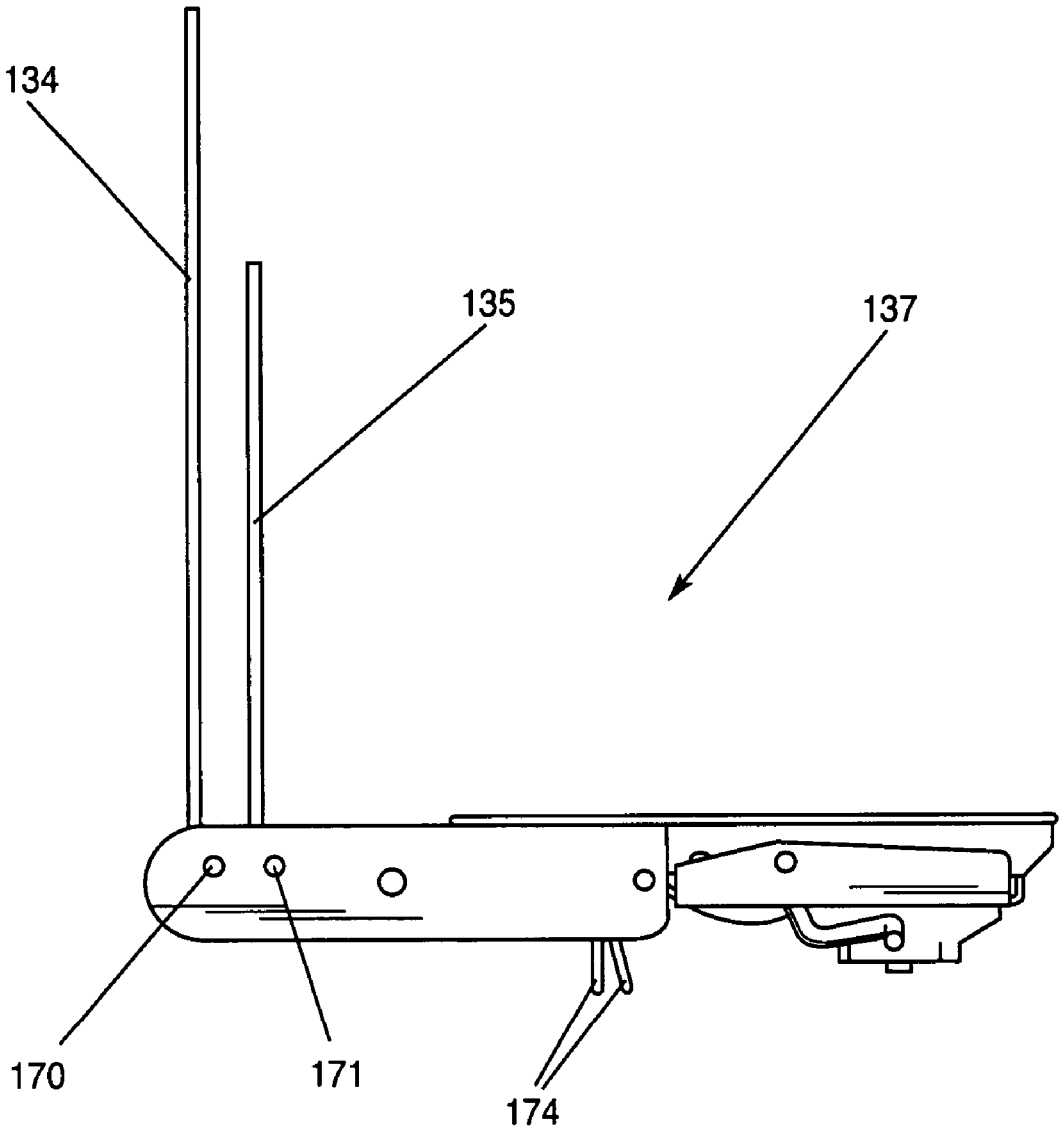
FIG. 9 is a side view of the back support control assembly of FIG. 8.
Figure 10:
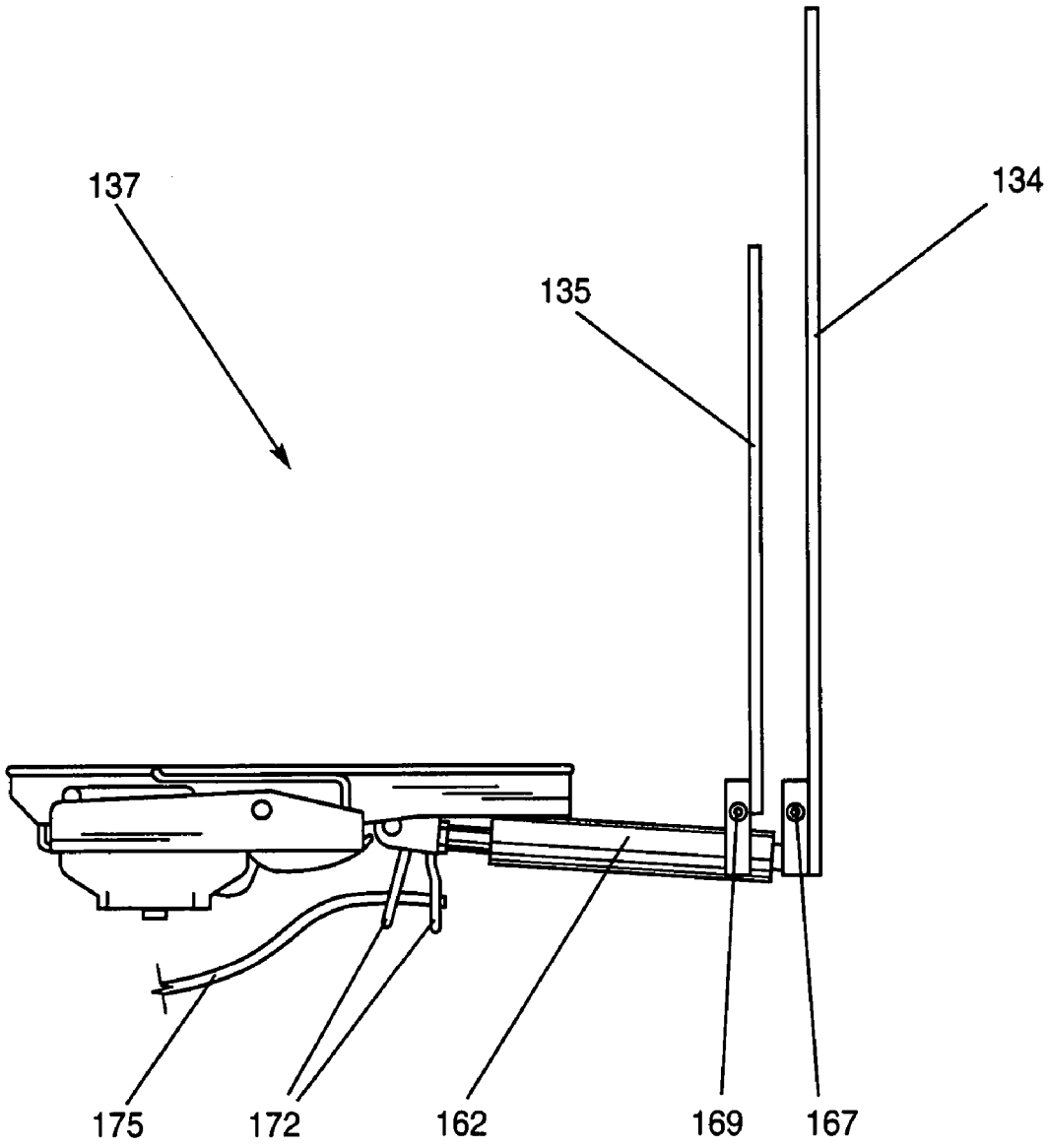
FIG. 10 is a side view of the back support control assembly of FIG. 8 with a covering removed to expose the lower ends of the back support arms.
Figure 11:
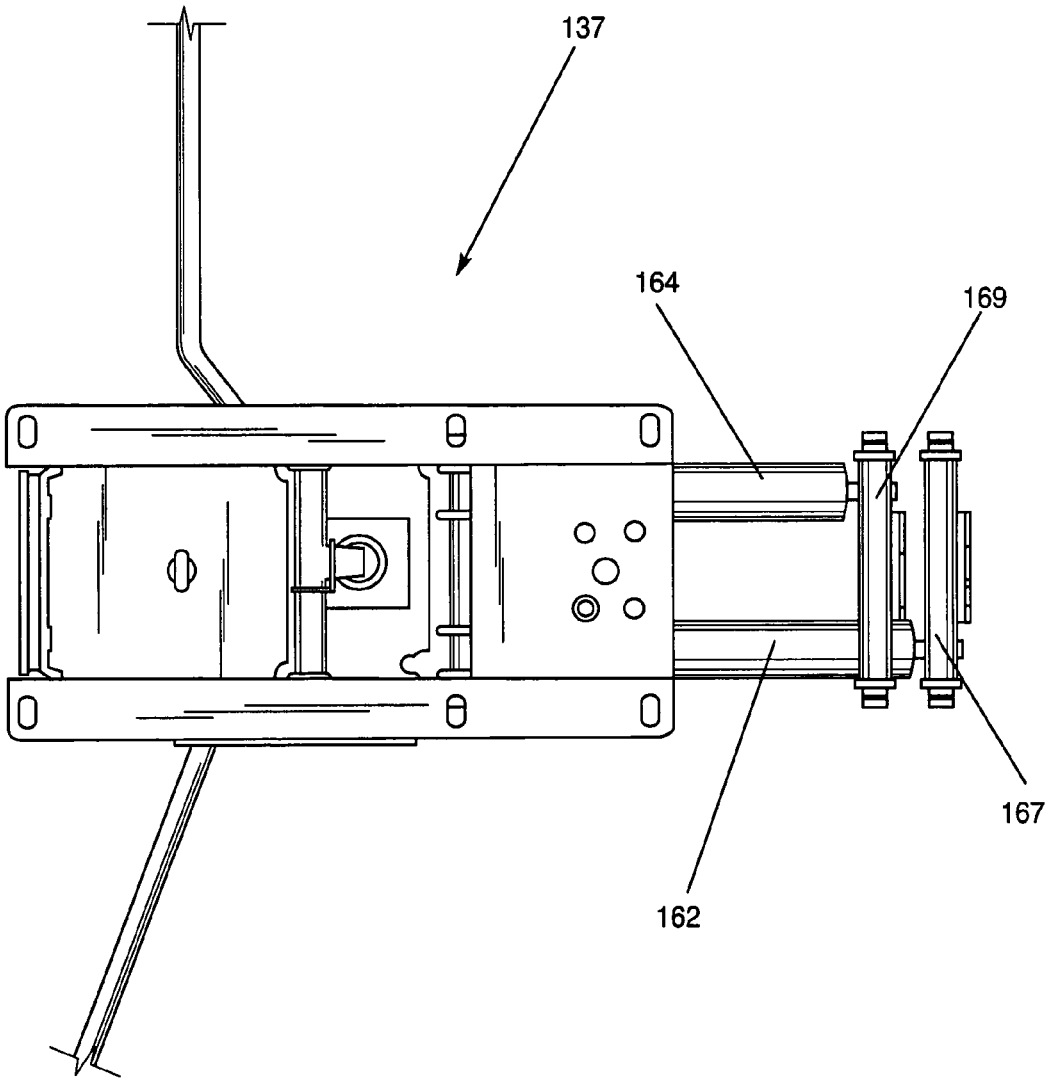
FIG. 11 is a top view of the back support control assembly of FIG. 8 with the back support arms removed.

FIG. 8 shows a detailed view of an embodiment of back support control assembly 137. A pair of actuator linkages 172 and 174, which are linked to adjustment controls 126, 128, are used to adjust back support arms 134, 135. FIG. 9 shows the front/back orientation of back support arms 134 and 135. FIG. 10 shows the bottom ends of back support arms 134 and 135 comprising interfaces 167 and 169 that connect to pneumatic gas cylinders 162, 164 which are in turn connected to linkages 172 and 174. Thus, in the embodiment shown in FIGS. 8-10, gas cylinders 162, 164 are connected to different and offset interfaces 167 and 169 which comprise rod-like portions as better shown in FIG. 11. Preferably, as better shown in FIG. 10, cylinders 162, 164 are connected to the bottom of interfaces 167, 169 at the lowermost ends of back control arms 134, 135 so that pivot points 170, 171 are located above the points of attachment of cylinders 162, 164 to interfaces 167, 169. This enables arms 134, 135 to move at fore and aft angles as shown in FIGS. 1-4. Linkages 172 and 174 are connected to cylinders 162 and 164 and are in turn linked to adjuster controls 126, 128 via actuator cables 175 (shown in FIG. 10) or the like. This enables any control mechanism or adjusting component, including actuator buttons 126, 128 to be easily located in virtually any location, in addition/alternatively to those depicted in the figures.

It should be apparent that the adjustment of back support arms 134 and 135 and back supports 132 and 133 may be accomplished by any means known in the art. For example, adjustments may be made with dials, slide mechanisms, and the like to control the height, angle, and/or other properties of back support members 132, 133.

Also, as shown in the figures, adjustment mechanisms such as control mechanisms 175 and 176 may be incorporated to control characteristics of chair 100, including, but not limited to, height, angle, tilt lock, and tilt tension of seat 150.

Thus, the present invention provides for a system of variable, and variably timed, seating positions, the system termed herein "active seating" which allows for periodic adjustments to various seat supporting members, and which allows the user's body to remain active, uncompromised, and functioning properly. The antithesis of "active seating" is "static seating". Static seating is undesirable as it is detrimental to the health and posture of the user. Static seating is overcome through the use of the present invention.

To increase the benefits of the present invention and enhance "active seating", another embodiment includes the incorporation of various adjustment alert means into chair 100, such as adjustment alert 180 as shown in FIG. 1, to alert a user that enough time has elapsed so that making an adjustment is advisable. Thus, a user can, without having to be too consciously engaged in the use of chair 100, be assured of not remaining in a static position for too long. Adjustment alert 180, sends an indicator signal such as, but not limited to, an audible alarm, to the user as a reminder to make modifications to the positions of the adjustable components of chair 100. Thus, a user is reminded to change positions to enhance the posture, biomechanics, etc. of the user.

Thus, the present invention provides a series of independent bracing supports anywhere along the line of vertebrae from the sacrum to the cervix. Depending on the embodiment, two or more independently adjustable back support arms are attached to, and arise from, the seating frame, seat support, seat pedestal, or seat. One or more back supports attach to these back support arms and each back support arm has flexible adjustments in order to accommodate individual user dimensions. This arrangement allows the user to participate in a wide range of tasks with optimum and healthy musculoskeletal support.

The ability to frequently reposition the support members described herein in order to effect periodic, slight anatomical movement of musculoskeletal, respiratory, nervous, digestive, and circulatory systems ensures that these body systems remain uncompromised and unimpinged. This periodic, slight repositioning of the various support members allows muscles to relax while redistributing anatomical pressure.

All elements described herein are preferably integrated to respond in concert to a myriad of user sizes and shapes and a wide variety of chair-based tasks with a healthy musculoskeletal support system.

EXAMPLE

A chair in accordance with the description provided herein was constructed with the following components:

1. A lower back support was attached to a lower back support arm, and an upper back support was attached to an upper back support arm.
2. The lower and upper back support arms were independently attached at respective pivot points to a back support control assembly which was in turn attached to a seat frame.
3. The upper back support arm was located directly behind the lower back support arm.
4. The lower and upper supports were adjustable up and down on the back support arms and could pivot on a plane parallel to the vertical axis of the back support arms.
5. The back support arms could be reclined forward or rearward.
6. The back supports and the back support arms were adjustable using adjusting components that in turn comprised window indicators to show the position settings of the back supports and back support arms.
7. The back support arms were adjustable using buttons linked via actuator linkages connected to pneumatic cylinders that were in turn connected to the lower ends of the back support arms.
8. The chair also comprised adjustable arm rests and an adjustable seat.
9. The back supports incorporated a vertical indentation for the relief of spinal pressure.

16. A base with casters was provided.

The preceding examples can be repeated with similar success by substituting the generically or specifically described components, mechanisms, materials, and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An adjustable chair comprising:

a base;

a seat comprising a seating surface, said seat connected to said base;

a back support control assembly connected to said seat for adjusting the fore and aft position of at least two adjustable, generally vertical back support arms, each said back support arm pivotally attached to said back support control assembly at spaced apart control assembly pivot points such that the at least two back support arms pivot about different pivot point axes, and each said back support arm independently adjustable about its said respective control assembly pivot point axis, said back support arms adjustable in the fore and aft position to vary an angle with respect to said seating surface; and a back support disposed on each said back support arm, a first of said back supports for supporting a lower back of a seated person and a second of said back supports supporting an upper back of the seated person.

2. The chair of claim 1 further comprising adjustment controls for adjusting a position of each said back support arm, said adjustment controls accessible to a user while seated.

3. The chair of claim 1 wherein said back supports are attached to said back support arms so that said back supports pivot to accommodate a user's back contours as said back support arms pivot about said control assembly pivot points.

4. The chair of claim 1 further comprising a first adjusting component connected to said first back support for vertically adjusting said first back support and further comprising a second adjusting component connected to said second back support for vertically adjusting said second back support, said adjusting components accessible to a user while the user is seated.

5. The chair of claim 4 wherein said first adjusting component faces toward a front of said chair.

6. The chair of claim 4 wherein said second adjusting component faces toward a rear of said chair.

7. The chair of claim 4 wherein said first adjusting component and said second adjusting component comprise adjustable settings for adjustment of a position of said back supports on each respective back support arm, said adjusting components comprising calibrations visible to a user.

8. The chair of claim 1 wherein said back support control assembly comprises pneumatic components attached to said back support arms to move and fix a position of each back support arm.

9. The chair of claim 8 wherein said pneumatic components comprise a first pneumatic cylinder linked to said first back support arm and a second pneumatic cylinder linked to said second back support arm, each of said pneumatic cylinders independently linked to an adjustor control via an actuator cable.

10. The chair of claim 1 wherein each back support further comprises a spinal relief channel.

11. The chair of claim 1 wherein said seating surface further comprises a coccyx pressure relief depression.

12. The chair of claim 1 further comprising at least two adjustable forearm supports.

13. The chair of claim 1 further comprising at least one adjustment alert integrated into the adjustable chair to remind a user to make positional adjustments of said back support arms, said back supports, or both.

14. An adjustable chair comprising:

a base;

a seat comprising a seating surface, said seat connected to said base;

a back support control assembly connected to said seat for adjusting the fore and aft position of at least two independently adjustable, generally vertical back support arms pivotally attached to said back support control assembly at longitudinally spaced apart control assembly pivot axes, wherein the back support arms are longitudinally spaced apart at their points of attachment to the back support control assembly; and a vertically adjustable back support disposed on each said back support arm, a first of said back supports for supporting a lower back of a seated person and a second of said back supports for supporting an upper back of the seated person.

15. The chair of claim 14, further comprising a first adjusting component and a second adjusting component for adjusting said first and second back supports, each said adjusting component comprising adjustable settings for adjustment of a position of said back supports on each respective back support arm, said adjusting components comprising calibration indicators visible to a user.

16. The chair of claim 15 wherein at least one of said calibration indicators comprises a letter.

17. The chair of claim 15 wherein at least one of said calibration indicators comprises a number.

18. The chair of claim 15 wherein at least one of said calibration indicators comprises a window showing a number, and another of said calibration indicators comprises a window showing a letter.

* * * * *